United States Patent [19]

Isikawa

[11] 4,344,613

[45] Aug. 17, 1982

[54] DEVICE FOR SUCCESSIVELY STRIPPING SHEET FROM A STACK OF SHEETS

[76] Inventor: Kingo Isikawa, 33-4, Doichi-cho 2-chome, Mizuho-ku, Nagoya-shi, Aichi-ken, Japan

[21] Appl. No.: 139,578

[22] Filed: Apr. 11, 1980

[30] Foreign Application Priority Data

Apr. 18, 1979 [JP] Japan ..... 54-47480

[51] Int. Cl.[3] ..... B65H 1/06

[52] U.S. Cl. ..... 271/165; 271/105

[58] Field of Search ..... 271/145, 165, 166, 105, 271/134

[56] References Cited

U.S. PATENT DOCUMENTS 2,378,306 6/1945 Leonhart ..... 271/165

2,390,573 12/1945 Dohl ..... 271/166

4,184,670 1/1980 Rosendahl ..... 271/165 X

*Primary Examiner*—Richard A,. Schacher

*Attorney, Agent, or Firm*—Erwin S. Teltscher

[57] ABSTRACT

Disclosed herein is an auxiliary device for successively stripping sheets of paper from a paper stack piece by piece. The device comprises a backplate in contact with a side surface of the paper stack and a plurality of flexible stripping members. The base portions of the stripping members are secured to the backplate while the forward ends of the same extend beyond the paper stack and have an inwardly facing curvature. The device further includes elastic members in contact with the outer surfaces of the stripping members. The elastic members have in the forward ends thereof means for urging the forward ends of the stripping members in a direction towards the paper stack.

8 Claims, 7 Drawing Figures

DEVICE FOR SUCCESSIVELY STRIPPING SHEET FROM A STACK OF SHEETS

BACKGROUND OF THE INVENTION

1. Field of the Invention

The present invention relates to an auxiliary device for removing sheets of paper piece by piece from a paper stack for feeding the sheets of paper to a printing process in facilities such as bookbinding shops and printing facilities.

2. Description of the Prior Art

A conventional auxiliary device for removing sheets of paper piece by piece from the lower part of a paper stack by a suction-type paper feeder comprises a backplate for a paper layer, a bolt threadedly engaged in the lower portion of the backplate through a spring and a tapered projection extending from the forward end of the bolt through the backplate. The tapered projection is adapted to make contact with the edges of the sheets of paper for preventing simultaneous removal of two or more sheets of paper from the paper stack. However, such a device is not very effective in stripping the sheets of paper piece by piece.

SUMMARY OF THE INVENTION

The object of the present invention is to provide an auxiliary device for successively removing sheets of paper accurately piece by piece from a paper stack.

According to the present invention, there is provided an auxiliary device for successively removing sheets of paper from a paper stack which comprises a backplate for the paper stack, a plurality of flexible stripping members extending inclinedly toward the paper stack from the end of the backplate in the vicinity of the sheet of paper to be removed and a plurality of serrations provided on the inner surface of the stripping members for removing the sheet of paper so as to prevent simultaneous stripping of two or more sheets of paper and facilitate accurate removal of the sheets of paper piece by piece. Therefore, smooth removal and feeding of sheets of paper may be conducted in facilities such as shops for binding books.

The device according to the present invention can also be applied to a system in which the sheets of paper are stripped from the upper part of the paper stack.

DESCRIPTION OF THE PREFERRED EMBODIMENTS

Figure 1:
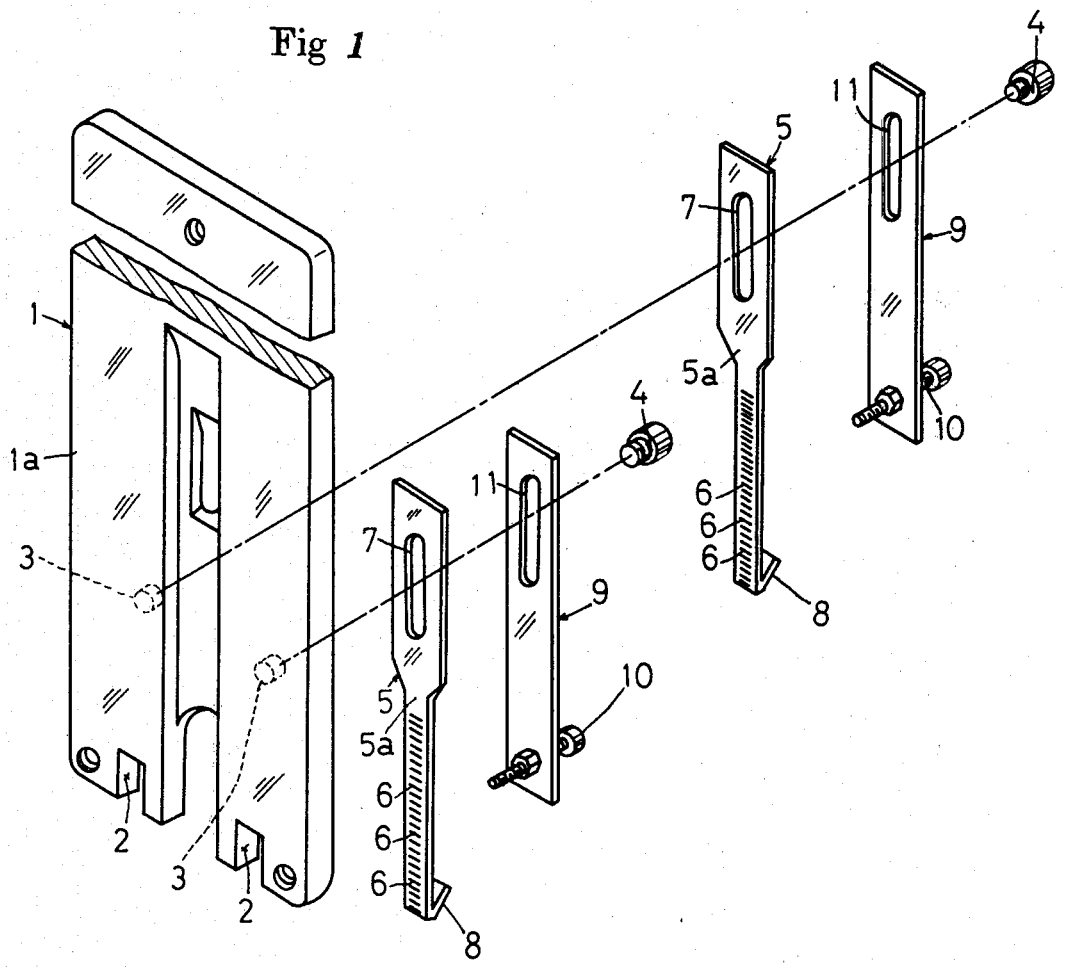
FIG. 1 is a first exploded perspective view of an embodiment of the device according to the present invention.
Figure 2:
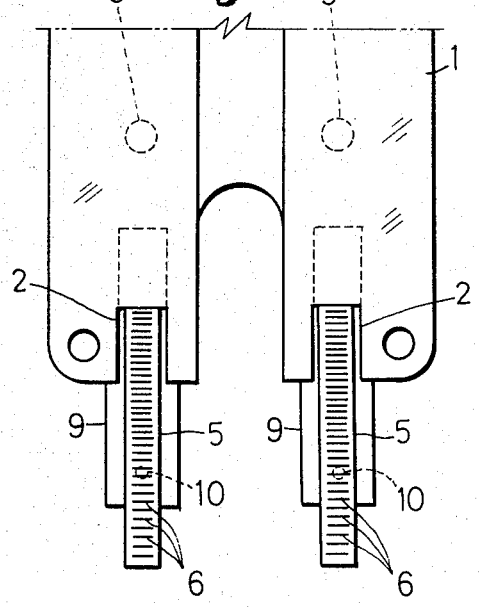
FIG. 2 is a front elevational view of the device of FIG. 1.
Figure 3:
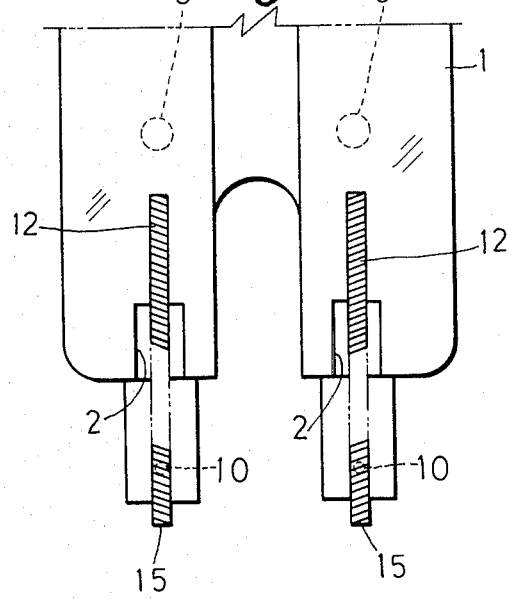
FIG. 3 is a front sectional view of a second embodiment of the invention.

Referring now to FIGS. 1 to 3 of the drawings, there is shown a backplate 1 made of a vertically rectangular metal sheet, of which the lower end is placed to be flush with the lowest sheet of paper P1 of a paper stack P in a conventional manner. The backplate 1 has a pair of rectangular recesses 2 in its lower end and a pair of tapped holes 3 provided in the outer surface 1*a* above the recesses 2. A pair of bolts 4 are threadedly engaged in the tapped holes 3 for securing stripping members 5 and resilient means, such as auxiliary elastic members 9 to the backplate 1 as hereinafter described.

Each of the stripping members 5 is made of a vertically rectangular flexible synthetic resin plate, and is provided on the lower half of its surface 5*a* with a plurality of horizontal jagged notches 6 which are triangular in section. Each of the stripping members 5 is further provided with a slot 7 in its upper portion, and the lower end thereof is bent outwardly at 8. The stripping members 5 are secured to the outer surface 1*a* of the backplate 1 threadedly through the slots 7 by the bolts 4 so that the notches 6 face the paper stack P and the lower parts thereof extend downwardly below the backplate 1.

Each of the elastic members 9 is made of a vertically rectangular plate spring, and is provided with a set bolt 10 threadedly passing through its lower portion and a slot 11 provided in the upper portion thereof. The elastic members 9 are secured to the outer surface of the stripping members 5 threadedly through the slots 11 by the bolts 4 so that the operative or forward ends of the set bolts 10 contact the lower portions of the stripping members 5 to force them to curve inwardly through the recesses 2 of the backplate 1.

Figure 4:
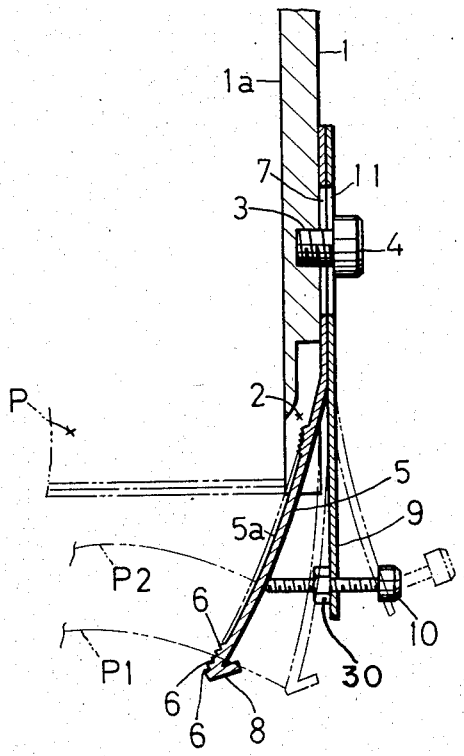
FIG. 4 is a side elevational view in section of the first embodiment of the device according to the present invention.

When the lowest or the first sheet of paper P1 is fed from the paper stack P by a conventional suction-type paper feeder (not shown), the second sheet of paper P2 which is in close contact with the first sheet of paper P1, tends to be removed from the paper stack P along with the first sheet of paper P1 pressing the stripping members 5 outwardly against the elastic members 9, as shown by the dash-dot-dot line in FIG. 4, by virtue of, for example, sticking together of any severed edges in the case of cutting of the paper stack P in a predetermined width by an excessive suction force exerted by the paper feeder, or by static electricity. However, since the edge of the respective second sheet of paper P2 makes successively contact the notches 6 of the stripping members 5, which, in turn, are vibrated by the contact, the second sheet of paper P2 is successfully separated from the first sheet of paper P1. In a like manner, every two adjacent sheets of paper are successively separated from each other, and thereby any feeding of two or more sheets of paper which overlap is effectively prevented.

Further, since the stripping members 5 and the elastic members 9 are provided with the slits 7 and 11, the length and the extent of curvation of the stripping members 5 can be appropriately adjusted relation to the quality of the paper.

Figure 5:
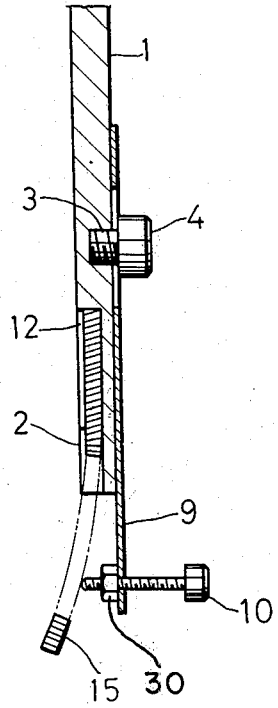
FIG. 5 is a side elevational view in section of the device of FIG. 3.

Attention is now drawn to FIGS. 4 and 5 showing the second embodiment of the present invention in which coiled springs 15 are utilized in place of the stripping members 5 of the first embodiment. In this embodiment, spring holders 12 are provided in the backplate 1 partly disposed in the recesses 2 for holding the upper portions of the coiled springs 15, of which the lower portions are forced to curve inwardly by the set bolts 10 of the elastic members 9 threadably passing through nuts 30 secured to respective elastic members 9. In this case, the uneveness of the surfaces of the coiled springs 15 substitute for the notches 6 of the stripping members 5 in the first embodiment for facilitating removal of the sheets of paper. The other portions of the second embodiment are constructed identically with those of the first embodiment. Therefore, no further description of the second embodiment will be necessary to anyone of ordinary skill in the art.

Figure 6:
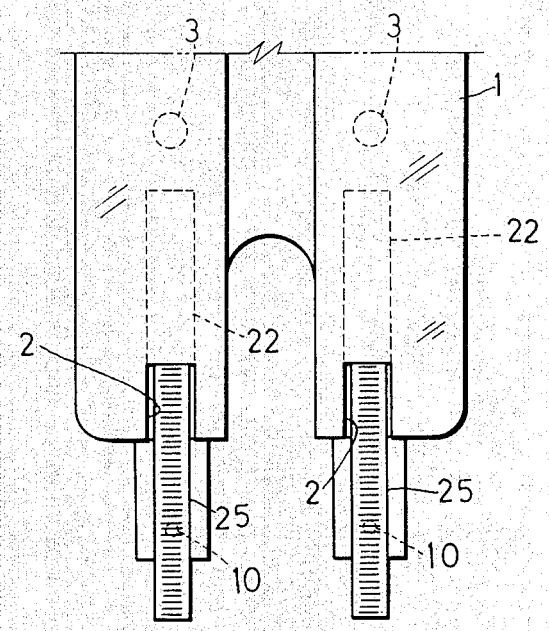
FIG. 6 is a front elevational view of a third embodiment of the device according to the present invention.
Figure 7:
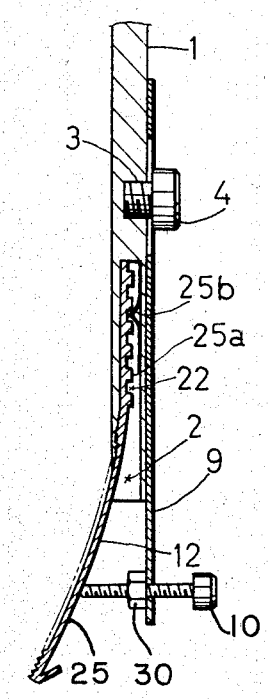
FIG. 7 is a side elevational view in section of the device of FIG. 6.

Attention is now drawn to FIGS. 6 and 7 in which a third embodiment of the present invention is shown. In this embodiment, each of stripping members 25, similar to the stripping members 5 of the first embodiment, has an uneven surface 25*a* in its upper rear portion which is in contact with a doglegged plate spring 25*b*, and both the uneven surface 25*a* and the plate spring 25*b* are fitted in a fitting hole 22. The other portions of the third embodiment are constructed identically with those of the first embodiment. Therefore, no further description of the third embodiment will be necessary to anyone of ordinary skill in the art.

In each of the aforementioned embodiments, the elastic members 9 for forcing the stripping members 5 to move inwardly may be omitted by imparting a preset curvature to the stripping members 5 prior to their installation in the device. Furthermore, the stripping members 5 may be constructed to be horizontally movable for adjustment in conformity with the respective width of a variety of paper.

The number of the stripping members 5 may be optionally increased or decreased.

While the invention has been described with reference to a few preferred embodiments thereof, it is to be understood that modifications or variations may be easily made without departing from the scope of this invention which is defined by the appended claims.

What is claimed is:

1. In a suction-type feeder for feeding sheets one by one from a stack of sheets having a feeding end, including a sheet immediately removable from said feeding end, and at least an other sheet in contact with the immediately removable sheet, the improvement comprising:

a backplate adapted to be in contact with a lateral side of said stack, a plurality of flexible sheet-stripping members, each including a base portion secured to said backplate, and a serrated operative portion extending from said base portion, adapted to extend in a direction at least partly over said feeding end of said stack, and being curved inwardly, and resilient means for urging said stripping members in said direction, the sheets, upon operatively making contact with said serrated operative portions, being induced to vibrate, whereby said other sheet is separated from the immediately removable sheet.

2. The improvement as claimed in claim 1, wherein each stripping member has an outer surface, and wherein said resilient means comprise a plurality of auxiliary members in contact, and cooperating with the respective outer surfaces of said stripping members, each auxiliary member having an operative end, and contacting means disposed on the operative end of each auxiliary member normally in contact with a corresponding stripping member.

3. The device as defined in claim 1 or 2 wherein said stripping members are coiled springs.

4. The device as defined in claim 2 wherein said elastic members are plate springs.

5. The improvement as claimed in claim 2, wherein each of said auxiliary members is an elastic member, and wherein said contacting means includes a presettable bolt.

6. The improvement as claimed in claim 5, wherein each of said elastic members includes a nut secured thereto, said bolt being threaded and passing through said nut.

7. The improvement as claimed in claim 1, wherein each stripping member includes a substantially rectangular plate composed of synthetic rubber.

8. The improvement as claimed in claim 1, wherein said stack of sheets is upright, said feeding end being a lower end thereof, and wherein each stripping member is adapted to extend in a direction at least partly below said feeding end.

* * * * *